United States Patent [19]

O'Brien et al.

[11] 4,103,617

[45] Aug. 1, 1978

[54] HAMMER ENERGY IMPACT CONTROL USING READ ONLY MEMORY

[75] Inventors: William L. O'Brien, Waterloo; Wayne M. Doran, Kitchener, both of Canada

[73] Assignee: NCR Canada Ltd. - NCR Canada Ltee, Mississauga, Canada

[21] Appl. No.: 758,220

[22] Filed: Jan. 10, 1977

[51] Int. Cl.[2] ..... B41J 7/92

[52] U.S. Cl. ..... 101/93.03; 101/93.19

[58] Field of Search ..... 101/93.03, 95.19, 93.15, 101/93.14, 93.35, 93.29-93.34, 93.48; 197/53-55, 49, 17-19

[56] References Cited

U.S. PATENT DOCUMENTS

| | | | |
|---|---|---|---|
| 3,144,821 | 8/1964 | Drejza | 101/93.03 |
| 3,172,353 | 3/1965 | Helms | 101/93.03 X |
| 3,712,212 | 1/1973 | Beery | 101/93.19 |
| 3,858,509 | 1/1975 | Grundherr | 197/49 X |

FOREIGN PATENT DOCUMENTS

| | | | |
|---|---|---|---|
| 2,249,538 | 5/1975 | France | 101/93.03 |

OTHER PUBLICATIONS

Barrow et al., IBM Tech. Discl. Bulletin, vol. 19, No. 8, 1/77, pp. 3107-3108.

*Primary Examiner*—Edward M. Coven
*Attorney, Agent, or Firm*—J. T. Cavender; Wilbert Hawk, Jr.; George J. Muckenthaler

[57] ABSTRACT

In impact printing mechanism for encoding magnetic or optical characters on documents, a hammer energy control is utilized for maintaining constant impact pressure for the various surface areas of such characters. The constant impact pressure is derived by selection of the correct hammer pulse width for the surface area of each character.

9 Claims, 6 Drawing Figures

HAMMER ENERGY IMPACT CONTROL USING READ ONLY MEMORY

BACKGROUND OF THE INVENTION

In the printing field, there has been much effort devoted to printing at higher speeds while, at the same time, maintaining print quality. As is well-known, a plurality of character fonts are utilized by businesses for various purposes, although there is a tendency to standardize the number of fonts so as to decrease costs of printing and to provide product compatibility between manufacturers of business equipment. As is also well-known, the surface area of characters to be printed varies substantially according to the number of different characters. For example, in impact printing mechanism for numerals 0–9 it is desirable that for each and every printed character, the quality of the printing should be uniform regardless of the surface area of the character.

In the past, all the characters have been grouped into two categories of high or low surface area, or at the most, into three or four different character areas or energy levels with the print quality being accepted for economic or technical reasons. Additionally, each energy level has usually required an independent adjustment of the impact hammers to obtain a nearly uniform surface area print quality.

Printing mechanism concerned with different surface area of characters is disclosed in U.S. Pat. No. 2,935,935, issued on May 10, 1960 to W. C. Preston et al., wherein a series of printing hammers are capable of delivering different impact energies on the various characters by providing means for controlling the amount of pressure that is applied to each print hammer.

Representative prior art of a variable force hammer high speed printer is U.S. Pat. No. 3,172,353, issued on Mar. 9, 1965 to C. J. Helms, which discloses magnetic braking and intensity control for low surface area and high surface area characters. A photosensitive element reads, by means of a code wheel, information identifying whether each character is a high or low surface area. Each character on the typewheel is represented by a six bit binary code which can be read from the code wheel by elements which are connected to a computer in which is stored the information to be printed. The computer compares each successive code read by the elements with the information to be printed and provides output signals which cause selected hammer coils to be energized for each position of the drum. The computer can provide either encoded address signals identifying particular hammers, or decoding means within the computer for providing an output signal on each line to a hammer to be actuated. Circuitry is provided to energize the coils at a certain time to cause information to be printed in accordance with information stored in the computer.

U.S. Pat. No. 3,218,965, issued on Nov. 23, 1965 to J. C. Simons et al., shows pressure control means for print hammers wherein a variable energy is provided to each print hammer dependent upon the surface area of the character to be printed. Each rack is positioned a differential distance according to its respective character, and a character area arm has indentations according to the surface area of the character to be printed. An energy sensor is actuated to sense which character is to be printed, the sensor having a projection to sense the indentation. Spring anchors, directly coupled to the springs which provide the driving energy for the hammers, are positioned according to energy sensors and a crank releases the hammers to print the respective characters.

U.S. Pat. No. 3,308,749, issued on Mar. 14, 1967 to A. A. Dowd, discloses print impression control for specially configured type elements wherein the rear surface of the print type element immediately behind the embossed character is inclined relative to the striking surface of the print hammer, the effect being that the impact force gradient corresponds to the surface area distribution of the character formed on the type element.

U.S. Pat. No. 3,513,774, issued on May 26, 1970 to J. P. Pawletko et al., discloses print hammer compensation effected wherein the type train velocity and the source voltage have timing pulses from an emitter driven in synchronism with a type chain applied to a single shot multivibrator and a filter to develop a velocity error voltage. This voltage is used as a reference for a constant current ramp connected to a Schmitt trigger for developing a velocity error time-corrected timing pulse, the pulse being applied to a voltage correction circuit for developing a further timing pulse, which is both velocity and voltage error time compensated.

And, U.S. Pat. No. 3,712,212, issued on Jan. 23, 1973 to J. Beery, discloses variable printer intensity control wherein a control circuit is associated with printing apparatus, viz. a document encoding station including an impact print member cooperable with a character bearing cyclically movable member. The control circuit includes gate means which, depending upon the surface area of the selected character to be printed, can modify the current supplied by the circuit to the energy producing means for impacting the hammer.

SUMMARY OF THE INVENTION

The present invention relates to impact printing mechanism and more particularly to control of print hammer energies dependent upon the surface area of the characters to be printed. The impact printing mechanism is used to encode magnetic (MICR) and optical (OCR) characters on documents wherein the impact of a magnetically-energized hammer forces the document and a ribbon against a raised character on the typewheel. The hammer impact energy is determined by the length of time that a fixed current level is held in the hammer coil. In addition, the hammer impact energy required to optimally print a given character is dependent upon that character's surface area.

For a given character font, it has been shown empirically that the hammer pulsewidth is linearly related to character surface area. From the equations derived, the optimum pulsewidths were determined for each of the characters in the given font and a pattern was established for each typewheel position. In the case of the E-13B font, the equation relating pulsewidth to character surface area is as follows: pulsewidth $= 4.88 + 0.27$ area, where the pulsewidth is in milliseconds and the character surface area is in square inches $\times 10^{-3}$.

For each typewheel position, the relative pulsewidth differences can be tabulated for the particular font characters so as to enable a computer or processor to generate a range of pulsewidths in specified increments, and by using a basic pulsewidth of limited duration, different pulsewidths can be generated from a basic 4 bit binary code. Additional pulsewidths required to establish values other than in the specified increments are supplied by an adjustable one-shot multivibrator. Such 4 bit binary code for each character is then stored in a read only memory table to define the appropriate pulse-width differential for each typewheel position.

As a pulse is always required to trigger the hammer energy one-shot multivibrator, the minimum pulse-width must be for a specific or predetermined duration of time. The information in the read only memory is used to generate a logic 1 pulse whose width is established by derivation in accordance with specified values. Optimum pulsewidths for each character of additional fonts can be derived to operate in the same manner as the E-13B font.

In view of the above discussion, the principal object of the present invention is to provide uniform printing of all characters.

Another object of the present invention is to provide means for controlling the hammer impact energy so as to maintain constant impact pressure on the various characters.

An additional object of the present invention is to provide an individually selected hammer energy level for each encoded character.

A further object of the present invention is to provide single adjusting means for linearly affecting all characters equally.

Another object of the present invention is to provide a simple method of accommodating diverse energy level configurations for different fonts.

Additional advantages and features of the present invention will become apparent and fully understood from a reading of the following description taken together with the annexed drawing, in which.

The encoding mechanism of the present invention basically includes a typewheel, a stepping motor for driving and controlling the rotation and position of the typewheel, and an electromagnetically operated hammer, the impact of which has previously been controlled by three potentiometers which regulated the hammer force to suit specific characters on the typewheel. The encoding is accomplished by transferring magnetic ink from a mylar ribbon onto a check or like document, wherein the proper hammer force is required for clear and uniform printing, which is essential for electronic reading of the encoded document. If the hammer force is not sufficient, the magnetic ink will not be completely removed from the mylar ribbon, whereas if the hammer force is too great, the hammer will bounce on the typewheel and cause some of the magnetic ink to be transferred from the check back onto the ribbon. The encoding mechanism hereof provides for seven fields of Magnetic Ink Character Recognition (MICR) or Optical Character Recognition (OCR) encoding on checks or documents.

The hammer is operated by a pulse of current to the hammer coil, the length in milliseconds of the pulse (pulse-width) determining the force with which the hammer strikes the specified character on the typewheel. If, as mentioned above, three potentiometers are used to adjust the force on the hammer to obtain substantially even printing quality, the typewheel characters are arranged into three groups of low, medium and high surface area. While a plurality of different character fonts may be utilized, such as E-13B, CMC-7, 1428, OCR-A and OCR-B, it has been found that generally the surface areas of certain of the characters vary from areas of other characters of the same type font. An exception to this would be the CMC-7 characters wherein all characters have almost identical surface areas. In the testing and development of apparatus and procedures for providing a proper hammer force (measured as pulsewidth to the hammer coil), it was found that such pulsewidth (the length in milliseconds of the current pulse) is linearly proportional to surface area of the character. The encoder unit developed is an electromechanical device designed to encode MICR (E-13B or CMC-7), using 8 characters per inch, or OCR (OCR-A or OCR-B), or 1428, using 10 characters per inch.

Figure 1:
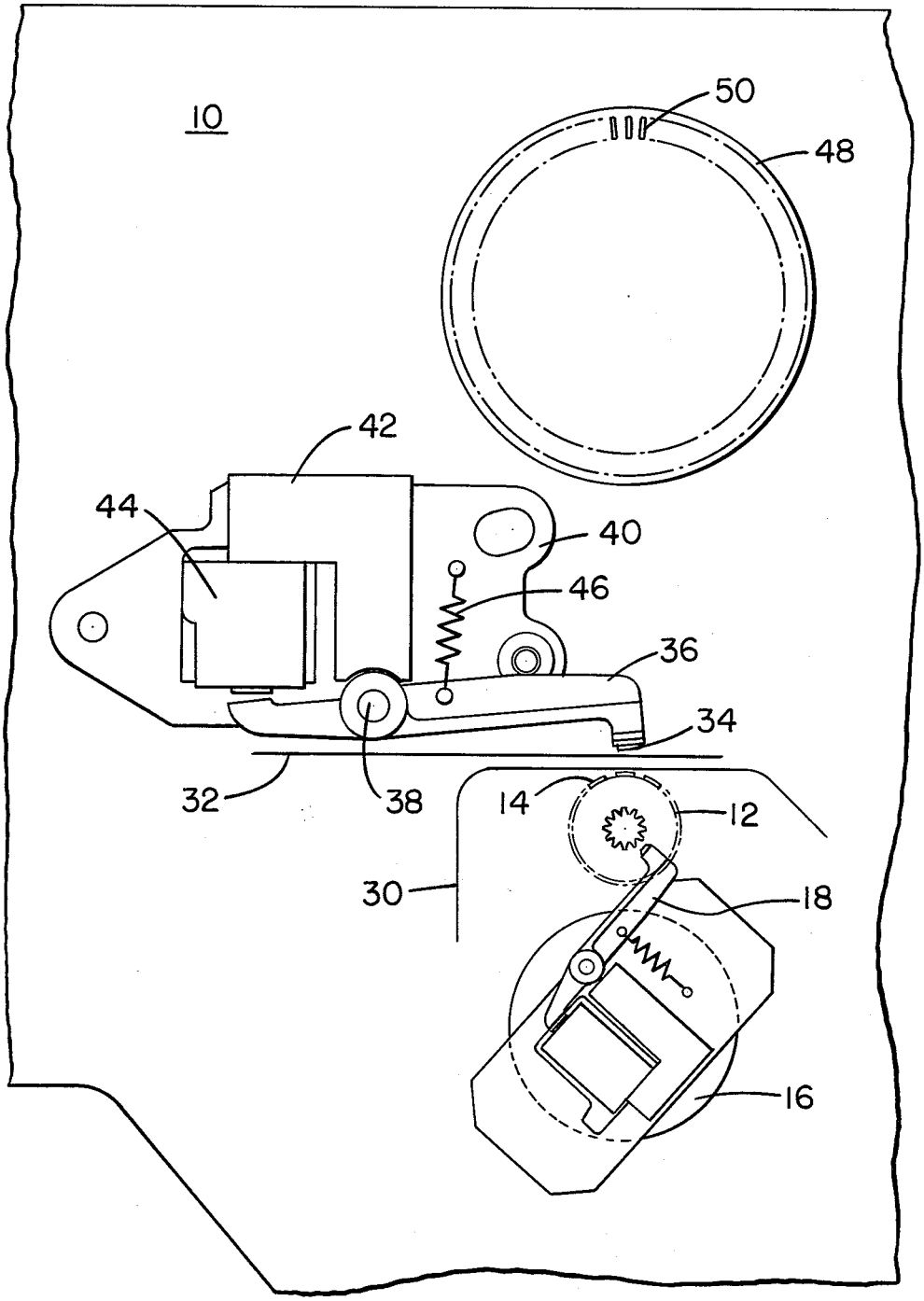
FIG. 1 is a side elevational view of encoding mechanism employing an impact-type print hammer and with which the present invention is associated.

Referring now to the drawing, FIG. 1 shows in side elevational view, the important parts of such an encoding mechanism as supported from a mounting plate 10 which may be one side frame member of a business machine. A typewheel 12 with type characters 14 on the periphery thereof is driven and controlled in incremental manner by a stepping motor 16, and an aligner mechanism 18 is positioned adjacent the motor 16. The aligner mechanism 18 is provided with well-known means, such as an aligning bar, engageable with the typewheel 12 for holding the typewheel in precise position during the printing operation. A ribbon 30 is caused to be driven in a path above the typewheel and a check or like document 32 may be placed or positioned above the ribbon 30 to be contacted by the impact face 34 of a print hammer 36 carried on a pivot 38 of a hammer frame 40. A hammer core 42 and a hammer coil 44 are carried on the frame 40 to operate the hammer 36 against the return force of a spring 46. A timing disc 48 having a plurality of slots or apertures 50 along the circumference thereof is rotatably supported adjacent the hammer 36 and the typewheel 12, and is operably connected with the motor 16. While the showing and the description of the encoding mechanism are limited in scope, the various parts and the operation of these parts are generally well-known in the encoding of documents.

Figure 2:
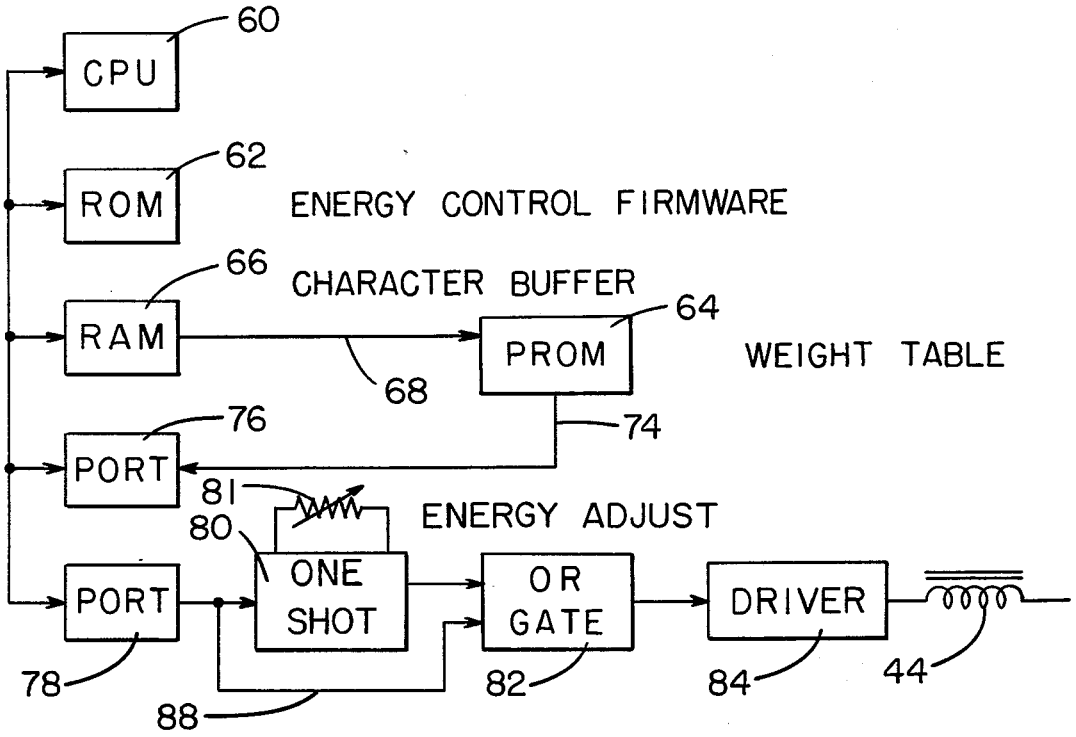
FIG. 2 is a block diagram of the print hammer controls.

FIG. 2 shows a block diagram including a central processing unit (CPU) or computer 60 of the microprocessor type, such as the MCS-4 integrated circuit assembly as manufactured by Intel Corporation, which will select the correct incremental hammer pulsewidth for each individual character 14 on the typewheel 12 from a look-up table. The unit program 62 (energy control firmware) is contained in a Read Only Memory (ROM) while the character program 64 (formatting) is contained in a Programmable Read Only Memory (PROM). Buffering for keyboard-entered and special control characters is realized in a Random Access Memory (RAM) 66 with one four-bit port output 68 to the PROM 64. A four-bit output 74 from the PROM 64 leads to a ROM input port unit 76, while an output port unit 78 provides memory for a signal to a one-shot multivibrator 80, through an OR gate 82 to the hammer driver 84 and to the hammer coil 44, the one-shot 80 having an adjustable device 81, in the form of a potentiometer, for adjusting the width of the pulse or signal to the OR gate 82. A by-pass 88 provides a circuit path around the one-shot 80 and serves as a second input to the OR gate 82.

Figure 3:
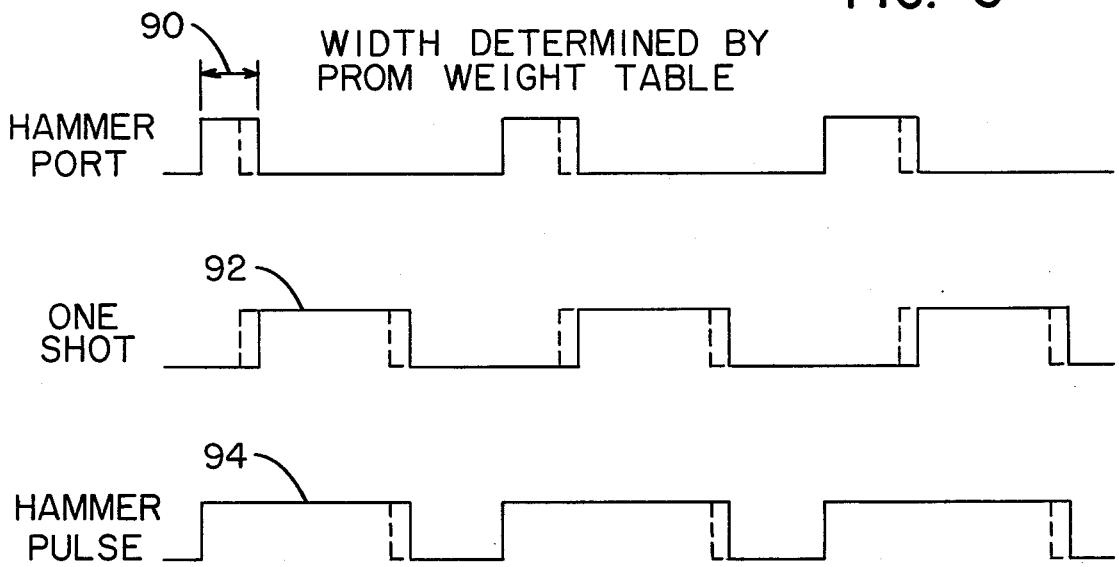
FIG. 3 is a timing chart of pulsewidths determined by character weights.

The timing chart of FIG. 3 illustrates the differences in weight of the surface area of several characters wherein the pulsewidth of one character, as determined from a weight corresponding to the character and selected from the PROM 64, is noted by the arrow 90. The adjustable one-shot 80 is pulsed in accordance with the signal 92 at a time delay from the signal 90, with a hammer pulse 94 being sustained for a time in accordance with the surface area of the character. Subsequent pulses are shown for characters with larger surface area.

Figure 4:
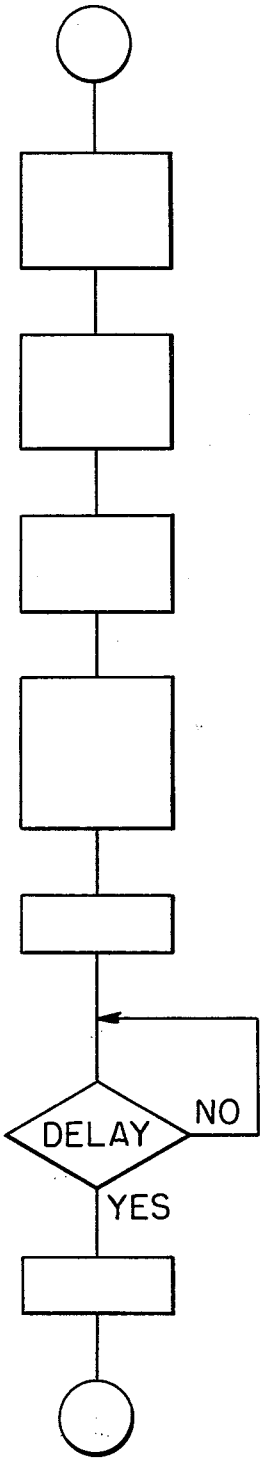
FIG. 4 is a flow diagram of the implementation of the hammer energy weights.

The flow diagram in FIG. 4 shows the various steps in implementing the hammer energy weights according to the surface area of the respective characters. Upon start of the encoding cycle, the first step is the obtaining of the typewheel data code of the character to be encoded from the Random Access Memory unit 66. Using the data code, the address of the corresponding hammer energy weight is generated for the Programmable Read Only Memory unit 64. The next step is the reading out of the hammer energy weight from the PROM 64. From this weight, a control count is generated for repetition of a fixed timing delay loop. The hammer 36, through coil 44, is then pulsed or turned on and another delay is performed. If the hammer time is completed, the hammer is turned off and the cycle is completed. If hammer time is not completed, a repeated delay is performed and the cycle is then repeated.

Figure 5A:
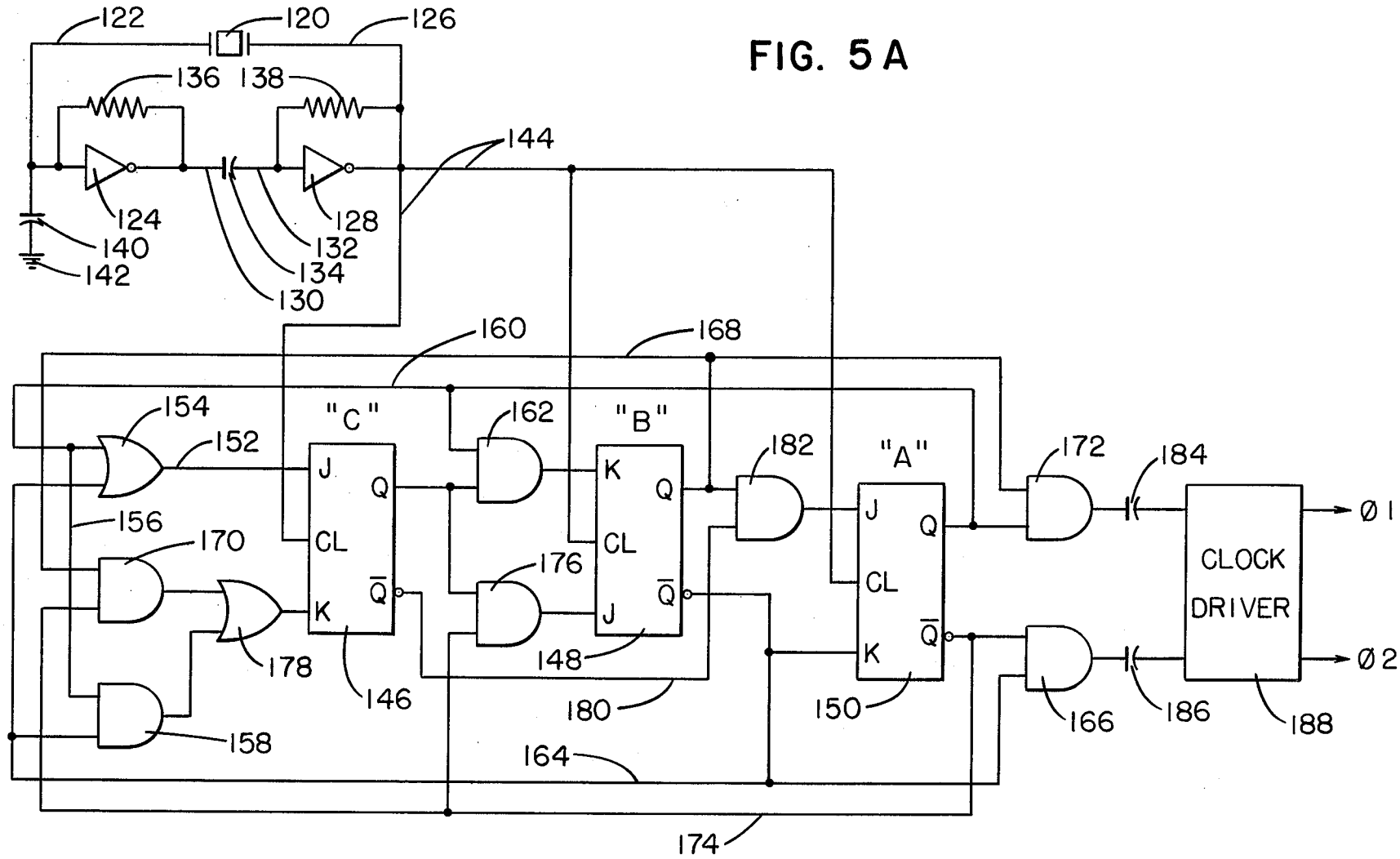
FIGS. 5A and 5B comprise a schematic diagram of the control system for the print hammer.
Figure 5B:
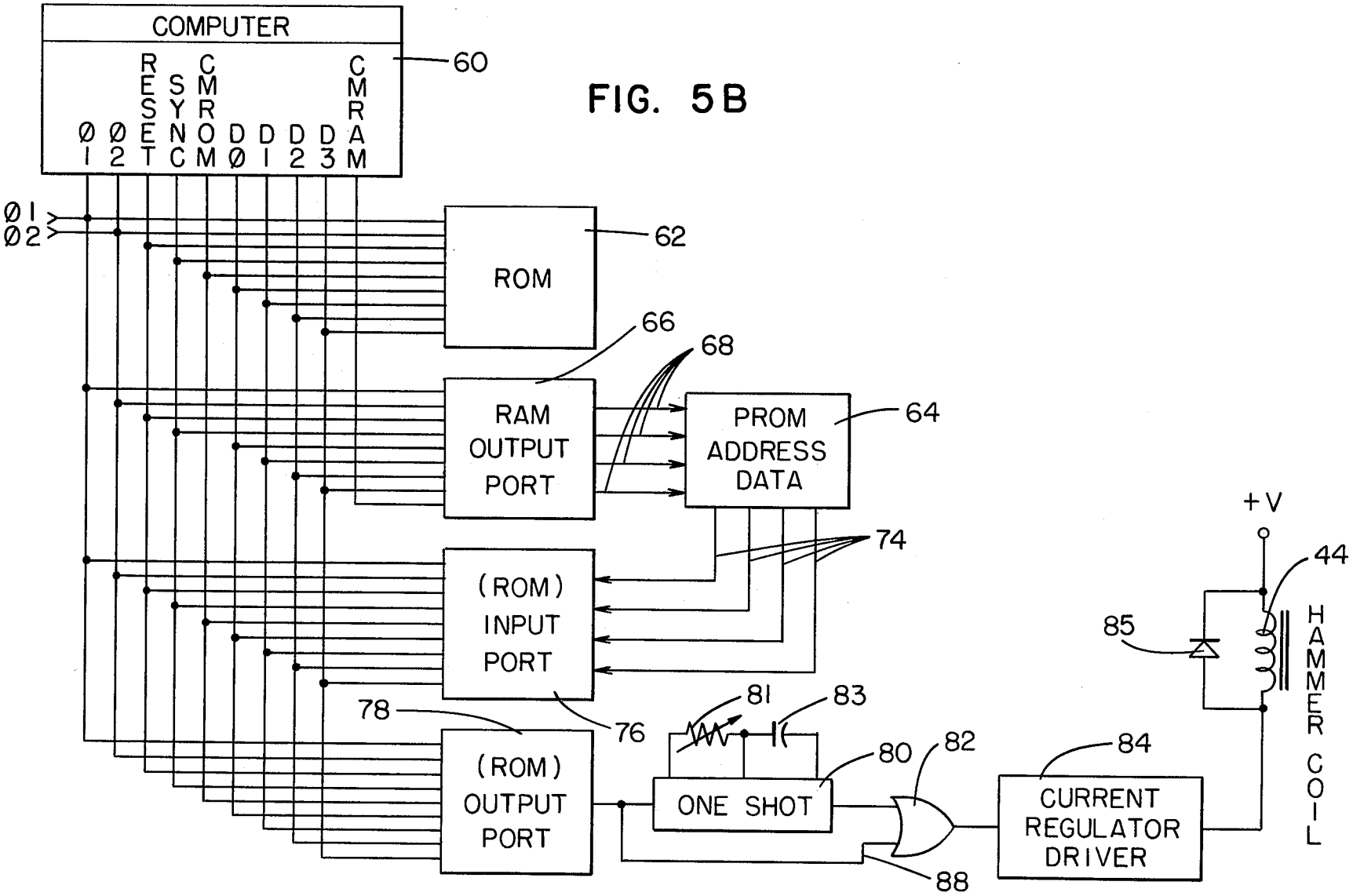

FIGS. 5A and 5B, when taken together, show the schematic diagram of the pertinent portions or areas of control logic required for impact control of the print hammer. As was mentioned previously, the impact of the hammer 36 is determined by the amount of current and the length of time that the current is applied to the hammer coil 44. Since the surface areas of the various characters in a given font differ, it is the intent of the present invention to provide a precise current pulse for each character of different surface area. A plurality of gates and flip-flops are included in the control circuitry wherein the central processing unit 60 (FIG. 5B) selects the respective energy weights from the weight table as determined previously and as set up in the weight table in accordance with the surface area of the respective characters.

The equations for the several fonts, as derived from a least-squares analysis of the character data, is as follows:

| Font | |
|---|---|
| E-13B | PW = 4.88 + 0.27 area |
| CMC-7 | PW = 5.4 |
| OCR-A | PW = 4.878 + 0.287 area |
| OCR-B | PW = 4.911 + 0.208 area |
| 1428 | PW = 4.692 + 0.342 area |

where PW is the pulsewidth in milliseconds and the area is the character surface area in square inches $\times 10^{-3}$. The fourteen position typewheel 12 utilized in the implementation of the encoding mechanism of the present invention includes positions for the characters 0–9 and five additional characters in a pattern as follows, which shows the optimum pulsewidth in milliseconds for each typewheel position of the several different fonts.

| Typewheel Position | E13B | CMC7 | OCRA | OCRB | 1428 |
|---|---|---|---|---|---|
| 0 | 5.55 | 5.4 | 5.73 | 5.48 | 5.65 |
| 1 | 5.72 | ↓ | 5.49 | 5.20 | 5.39 |
| 2 | 5.43 | ↓ | 5.65 | 5.34 | 5.57 |
| 3 | 5.65 | ↓ | 5.61 | 5.40 | 5.50 |
| 4 | 5.77 | ↓ | 5.43 | 5.32 | 5.33 |
| 5 | 5.53 | ↓ | 5.59 | 5.35 | 5.57 |
| 6 | 5.71 | ↓ | 5.61 | 5.35 | 5.51 |
| 7 | 5.4 | ↓ | 5.41 | 5.26 | 5.24 |
| 8 | 6.16 | ↓ | 5.78 | 5.51 | 5.64 |
| 9 | 5.73 | ↓ | 5.59 | 5.37 | 5.49 |
| 10 | 5.58 | ↓ | 5.47 | 5.20 | 4.88 |
| 11 | 6.01 | ↓ | 5.47 | 5.20 | 5.21 |
| 12 | 5.55 | ↓ | | | 4.88 |
| 13 | 5.71 | ↓ | | | 5.69 |
| 14 | 5.59 | ↓ | 5.54 | 5.16 | 5.03 |

The following table shows the relative pulsewidth differences in milliseconds for each typewheel position of the several character fonts.

| Typewheel Position | E13B | CMC7 | OCRA | OCRB | 1428 |
|---|---|---|---|---|---|
| 0 | .150 | .000 | .320 | .320 | .770 |
| 1 | .320 | ↓ | .080 | .040 | .510 |
| 2 | .030 | ↓ | .240 | .180 | .690 |
| 3 | .250 | ↓ | .200 | .240 | .620 |
| 4 | .370 | ↓ | .020 | .160 | .450 |
| 5 | .130 | ↓ | .180 | .190 | .690 |
| 6 | .310 | ↓ | .200 | .190 | .630 |
| 7 | .000 | ↓ | .000 | .100 | .360 |
| 8 | .760 | ↓ | .370 | .350 | .760 |
| 9 | .330 | ↓ | .180 | .210 | .610 |
| 10 | .180 | ↓ | .060 | .040 | .000 |
| 11 | .610 | ↓ | .060 | .040 | .330 |
| 12 | .150 | ↓ | — | — | .000 |
| 13 | .310 | ↓ | — | — | .810 |
| 14 | .190 | ↓ | .130 | .000 | .150 |

The following table shows the weight of each character in a 4-bit binary-decimal equivalent which is stored in the PROM 64 and which defines the appropriate pulsewidth differential in accordance with the values in the table immediately above.

| Typewheel Position | PROM Weight (4 bit binary-decimal equivalent) | | | |
|---|---|---|---|---|
| | E13B | OCRA | OCRB | 1428 |
| 0 | 3 | 5 | 5 | 13 |
| 1 | 5 | 1 | 1 | 9 |
| 2 | 1 | 4 | 3 | 12 |
| 3 | 4 | 3 | 4 | 10 |
| 4 | 6 | 0 | 3 | 8 |
| 5 | 2 | 3 | 3 | 12 |
| 6 | 5 | 3 | 3 | 11 |
| 7 | 0 | 0 | 2 | 6 |
| 8 | 13 | 6 | 6 | 13 |
| 9 | 6 | 3 | 4 | 10 |
| 10 | 3 | 1 | 1 | 0 |
| 11 | 10 | 1 | 1 | 6 |
| 12 | 3 | — | — | 0 |
| 13 | 5 | — | — | 14 |
| 14 | 3 | 2 | 0 | 3 |

Using the relative pulsewidth differences for each typewheel position of the several character fonts, the central processing unit 60 generates pulsewidths ranging from 0 to 0.810 milliseconds. The additional pulsewidth required to make up each of the values shown for the optimum pulsewidths shown in the first table (pulsewidth vs. typewheel position) are supplied by the adjustable device 81 of the one-shot 80. The clock rates utilized in the present encoder generate pulsewidths in increments of 11.9 microseconds with the minimum pulsewidth being 23.8 microseconds. Applying a basic pulsewidth of 59.5 microseconds, sixteen different pulsewidths ranging from 0 to 892.5 microseconds (in increments of 59.5 microseconds) can be generated when using a 4 bit binary code. The PROM weight for each character is thus stored for selection of the proper weight accorded to each character by the processing unit 60.

As a pulse is always required to trigger the hammer energy one-shot 80, the minimum pulsewidth must be 23.8 microseconds. The information in the PROM 64 must be used to generate a logic 1 pulse (at the appropriate output port bit 74) whose pulsewidth is established as follows: pulsewidth (microseconds) = 23.8 + (PROM weight × 59.5). The equivalent instruction cycles = 2 + (PROM weight × 5) wherein 1 cycle = 11.9 microseconds. It should be noted that for the CMC-7 font, the microprocessor program should generate a 23.8 microsecond pulse for all typewheel positions and that the optimum pulsewidth for all positions is 5.4 milliseconds, as seen in the first table. Also there is no relative pulsewidth difference among the positions, as shown in the second table (pulsewidth difference vs. typewheel position). Although not a part of the present invention, it should be noted that program switches are provided in the control system to provide a method of specifying or selecting a particular font to be used in the encoding mechanism.

Having set the background parameters for the difference in surface area of the respective characters for the several fonts and the difference in pulsewidths for maintaining the proper hammer energy weight or pressure for each respective character, the diagram of FIGS. 5A and 5B is useful for showing the control logic of the pertinent areas of the encoding mechanism.

Referring to FIG. 5A, which shows the schematic diagram of the control circuitry for the print hammer 36 and its coil 44 for operating in accordance with the surface areas of the respective type characters 14 on the typewheel 12, a piezoelectric crystal 120 is connected through a lead 122 as an input to one side of an inverting amplifier 124 and through a lead 126 as an output from one side of a further inverting amplifier 128, such amplifiers 124 and 128 being coupled by leads 130 and 132 to a fixed capacitor 134. A resistor 136 is connected across the amplifier 124 and a resistor 138 is connected across the amplifier 128. The one side of the crystal 120 is also connected through the lead 122 to a capacitor 140 and then to a ground 142. Leads 144 connect the output of the inverting amplifier 128 to the clock terminal of each of three J-K flip-flops 146, 148 and 150.

Flip-flop 146 has its J or set input derived via a lead 152 from the output of an OR gate 154, one input to the OR gate 154 being connected with a lead 156 to one input of an AND gate 158 — such OR gate 154 one input also being connected through a lead 160 to the Q output of the flip-flop 150 and to one input of an AND gate 162. The second input to OR gate 154 is derived through a lead 164 connected with a second input to the AND gate 158, connected with the $\overline{Q}$ output of flip-flop 148, and connected to one input of an AND gate 166. A lead 168 is connected to one input of an AND gate 170, to the Q output of flip-flop 148, and to one input of an AND gate 172. A lead 174 is connected to the second input of the AND gate 170, to one input of an AND gate 176 and to the $\overline{Q}$ output of the flip-flop 150. The outputs of AND gates 158 and 170 provide the inputs to an OR gate 178, the output of which OR gate 178 is connected to the K input of the flip-flop 146. A lead 180 is connected to the $\overline{Q}$ output of flip-flop 146 and to one input of an AND gate 182, the other input of such AND gate 182 being connected with the Q output of flip-flop 148. The Q output of flip-flop 146 is connected to the second input of AND gate 162 and to the second input of AND gate 176. The outputs of such AND gates 176 and 162 are connected to the J or set input and to the K or reset input, respectively, of the flip-flop 148. The output of AND gate 182 is connected to the J input of flip-flop 150 and the $\overline{Q}$ output of flip-flop 148 is connected to the K input of such flip-flop 150. The Q output of flip-flop 150 is connected as the second input to the AND gate 172 and the $\overline{Q}$ output of such flip-flop 150 is connected as the second input to the AND gate 166. Fixed capacitors 184 and 186 are inserted in the lines connecting the outputs of AND gates 172 and 166, respectively, and connected as the inputs to a clock driver 188, the two outputs of which clock driver are connected to terminals in the central processing unit 60.

The various memory units are shown interconnected in FIG. 5B by expanding the connections shown in FIG. 2 in an arrangement for further identifying the terminals in the microprocessor 60 and the signals outputting therefrom. The ROM unit 62 is connected to the microprocessor 60 via nine leads as shown, as are also the ROM port units 76 and 78. The RAM unit 66 is likewise connected to the microprocessor 60 by nine leads but is differentiated from such ROM units by a RAM vs. the ROM command lines associated therewith. A four-bit output 68 from the RAM unit 66 provides address signals to the PROM unit 64 and a four-bit output 74 feeds data therefrom to the ROM unit 76. The output of ROM unit 78 is connected to the one-shot multivibrator 80, the output of which one-shot is connected to one input of the OR gate 82. The second input to the OR gate 82 is derived from the by-pass line 88 to provide a differential pulsewidth and accordingly a differential hammer energy level as determined by the weights selected from the energy table of the PROM unit 64. The one-shot 80 includes the adjustable potentiometer 81 and a fixed capacitor 83. A diode 85 is provided for the hammer coil 44 to limit the surge of current on such coil.

In the operation of the encoding mechanism to provide for proper control of hammer impact energy for the particular surface area of each character of a selected font of characters, the central processing unit 60 selects from the programmable read only memory 64 the differential pulsewidth for each character to be printed. The respective weights for the characters in the memory table are set out in a code which takes into account the minimum pulsewidths by use of the adjustable device 81 of the one-shot 80 to provide a specific pulsewidth for each character dependent upon the surface area thereof.

More particularly, and referring back to FIG. 5A, the inverters 124 and 128, together with the piezoelectric crystal 120, and passive elements 134, 136, 138, and 140 form a free-running nonlinear oscillator circuit. The oscillator output appears on line 144 as a digital pulse train with a repetition rate of 4.704 MHz.

The function of flip-flops 146, 148, and 150, in conjunction with OR gate 154, AND gates 170 and 158, OR gate 178, and AND gates 162, 176 and 182 is to generate a modulo 7 count sequence. The counter outputs are combined by AND gates 166 and 172 to eventually form the phase 1 and phase 2 clock signals (designated $\phi$1 and $\phi$2 respectively) which are required for proper operation of the central processing unit 60. The sequential logic states are defined as follows:

| State | $\phi 2$ | $\phi 1$ | $Q_C$ | $Q_B$ | $Q_A$ |
|---|---|---|---|---|---|
| 1 | 0 | 1 | 0 | 0 | 0 |
| 2 | 0 | 1 | 1 | 0 | 0 |
| 3 | 0 | 0 | 1 | 1 | 0 |
| 4 | 0 | 0 | 0 | 1 | 0 |
| 5 | 1 | 0 | 0 | 1 | 1 |
| 6 | 1 | 0 | 1 | 1 | 1 |
| 7 | 0 | 0 | 1 | 0 | 1 |
| 1 | 0 | 1 | 0 | 0 | 0 |

For purposes of clarification, flip-flop 150 is referred to as flip-flop A, flip-flop 148 as B, and flip-flop 146 as C.

The corresponding logic equations are (wherein · = and, + = or):

$$J_A = Q_B \cdot \overline{Q}_C$$

$$K_A = \overline{Q}_B$$

$$J_B = \overline{Q}_A \cdot Q_C$$

$$K_B = Q_A \cdot Q_C$$

$$J_C = Q_A + \overline{Q}_B$$

$$K_C = \overline{Q}_A \cdot Q_B + Q_A \cdot \overline{Q}_B$$

$$\phi 1 = Q_A \cdot Q_B$$

$$\phi 2 = \overline{Q}_A \cdot \overline{Q}_B$$

The design of the counter is such that only one of the flip-flops 146, 148 and 150 changes state at a time, thus the design is hazard-free.

The logic levels at the output of AND gates 166 and 172 are:

logic 1 = +5VDC logic 0 = OVDC

These logic levels are A.C. coupled via capacitors 184 and 186 to the input of clock driver 188. The $\phi 1$ and $\phi 2$ outputs of the clock driver have the logic levels logic 1 = −10VDC logic 0 = +5VDC as required by the central processing unit.

Referring now to FIG. 5B, the control lines associated with the central processing unit 60 have the following functions:

$\phi 1$ and $\phi 2$: Two phase clock signal used to initiate logic and refresh cycles.

Reset: An external RESET signal used to clear all registers and flip-flops.

Sync: A synchronization signal used to initiate a machine instruction cycle.

CMROM: A control line used to activate the program ROM.

CMRAM: A control line used to activate the selected RAM.

D$\phi$, D1, D2, D3: Bidirectional data bus used to transfer both data and address information.

A typical encoding mechanism cycle starts with the computer 60 sending a synchronization signal (SYNC) to the ROMs and RAMs. Next, 12 bits of ROM address are sent to the data bus using three clock cycles. The address is then incremented by one and stored in the internal computer program counter. The selected ROM sends back 8 bits of instruction or data during the following two clock cycles. The next three clock cycles are used to execute the instruction.

The instructions are stored in ROM 62 to access the code for the next typewheel character to be printed (stored in RAM 66), to place the address of the PROM 64 location containing the corresponding energy weight onto the RAM output port 66, read the selected weight appearing at the ROM input port 76, and generate a logic 1 signal at the ROM output port 78 for a time duration equivalent to the selected energy weight. The logic 1 signal so developed is applied through bypass 88 and OR gate 82 to activate a constant current regulator 84 (FIG. 5B), and thus the hammer coil 44, for an equivalent time duration. The time duration of the logic 1 signal appearing at ROM output port 78 thus assumes a value appropriate for the energy required to print the selected character. When this logic 1 signal reverts to the logic 0 state, the output of one-shot 80 is activated to bring the total energy up to the level required for printing. The pulsewidth of one-shot 80 may be varied by adjusting the potentiometer variable resistor 81 to compensate for encoder unit to encoder unit variations. The impact velocity of the print hammer 36 and hence the impact energy, is directly proportional to the length of time the current regulator/driver output 84 is activated, and hence to the time a logic 1 appears at the output of the OR gate 82.

It is thus seen that herein shown and described is a hammer energy impact control system wherein the quality of the encoding is consistent from character to character, wherein a wider variation in printing medium can be utilized, and wherein the adjustment of the energy level is simplified, requires less skill, and consumes less time. The system enables the accomplishment of the objects and advantages mentioned above, and while one embodiment has been disclosed herein, variations thereof may occur to those skilled in the art. It is thus contemplated that all such variations, not departing from the spirit and scope of the invention hereof, are to be construed in accordance with the following claims.

What is claimed is:

1. In a printer having movable means for carrying type characters, hammer means for impacting against the type characters, and means for controlling the impact energy of said hammer means, said impact energy controlling means including first memory means containing coded data of the position of said type characters on said movable means, second memory means containing coded data representative of the surface areas of the respective type characters;

computer means for selecting coded data from said second memory means as defined by the type character being printed, and means for energizing said hammer means for a duration comprising the sum of a fixed period of time and of an additional period of time representative of the coded data selected by said computer means.

2. In the printer of claim 1 including means for adjusting the duration of time of energization of said hammer means.

3. In the printer of claim 1 including a one-shot multivibrator device for linearly adjusting the duration of time of energization of said hammer means for impacting said type characters.

4. In a printer having a type character bearing member, means for incrementally advancing said member into a plurality of printing positions, hammer means for impacting against said type characters, and means for controlling the impact energy of said hammer means against the surface area of said type characters, said controlling means including first memory means having coded data representative of the position of said type characters, second memory means programmed to generate character weights from said coded data representative of the surface area of said characters, third memory means having instructions for addressing said second memory means, computer means for selecting the character weights from said second memory means of the position and the surface area of the type character to be printed, and means for energizing said hammer means against said type characters for a duration comprising a fixed period of time and a variable period of time of energization for the respective character weight selected from said second memory means.

5. In the printer of claim 4 wherein said first memory means comprises a random access program of data representing the position of the respective type characters to be printed.

6. In the printer of claim 4 wherein said second memory means comprises a readable program representative of the coded data in said first memory means.

7. In the printer of claim 4 wherein said computer means for selecting the character weights is a microprocessor programmed in a manner representative of the surface area of said type characters.

8. In the printer of claim 4 including means for adjusting the duration of time of energization of said hammer means.

9. In the printer of claim 4 including a one-shot multivibrator device for linearly adjusting the duration of time of energization of said hammer means for impacting said type characters.

* * * * *